US005701832A

United States Patent [19]

Tajima et al.

[11] Patent Number: 5,701,832

[45] Date of Patent: Dec. 30, 1997

[54] MULTI-HEAD SEWING MACHINE

[75] Inventors: Ikuo Tajima; Terutada Kojima; Tomoaki Anesaki; Minao Fukuoka, all of Kasugai, Japan

[73] Assignee: Tokai Industrial Sewing Machine Co., Ltd., Aichi, Japan

[21] Appl. No.: 611,072

[22] Filed: Mar. 5, 1996

[30] Foreign Application Priority Data

Mar. 7, 1995 [JP] Japan ..... 7-077253
Mar. 7, 1995 [JP] Japan ..... 7-077254

[51] Int. Cl.[6] ..... D05B 25/00; D05C 3/02

[52] U.S. Cl. ..... 112/155; 112/221; 112/98; 112/163

[58] Field of Search ..... 112/155, 220, 112/221, 80.4, 284, 98, 163, 78

[56] References Cited

U.S. PATENT DOCUMENTS 3,468,273 9/1969 Lester ..... 112/155 X
3,783,811 1/1974 Schmedding et al. ..... 112/155 X
4,641,591 2/1987 Draghicchio ..... 112/155
4,852,506 8/1989 Salganik ..... 112/155 X

FOREIGN PATENT DOCUMENTS 2673205 8/1992 France ..... 112/163

*Primary Examiner*—Paul C. Lewis
*Attorney, Agent, or Firm*—Koda and Androlia

[57] ABSTRACT

Disclosed is a multi-head sewing machine having an improved structure for driving a main shaft and a lower shaft for driving needle bars and thread take-up levers so as to prevent distortion of these shafts, in turn, variation of stitch performance in the respective heads from occurring. The sewing machine comprises a plurality of heads, having at least a needle bar and a thread take-up lever, arranged in a row; a plurality of shuttle holders corresponding to the number of heads, each supporting therein a shuttle, arranged in a row; a main shaft, penetrating the row of heads, which rotates to drive the needle bar and the thread take-up lever in each head; and a lower shaft, penetrating the row of shuttle holders, which rotates to drive the shuttle in each shuttle holder; wherein the sewing machine further comprises a drive shaft, extended parallel to the main shaft, which is rotationally driven by a drive motor, the rotational driving force of the drive shaft being adapted to be transmitted to the main shaft at more than one position.

1 Claim, 15 Drawing Sheets

( a )

( b )

MULTI-HEAD SEWING MACHINE

BACKGROUND OF THE INVENTION

1. Field of the Invention

The present invention relates to a multi-head sewing machine having a plurality of heads, more particularly to an improved structure of driving a main shaft and a lower shaft which drive needle bars and thread take-up levers in the respective heads of the multi-head sewing machine.

2. Description of the Related Art

In the multi-head sewing machine, a plurality of heads each having needle bars and thread take-up levers are arranged linearly in the horizontal direction with respect to a machine frame. Meanwhile, on the lower surface of a table in the multi-head sewing machine, a plurality of shuttle holders each having a shuttle accommodated in it are likewise arranged linearly in the horizontal direction. Each shuttle interlocks with the needle bars in the corresponding head.

A common main shaft penetrates the heads to transmit a driving force to the needle bars and thread take-up levers in the respective heads, while a common lower shaft penetrates the shuttle holders to transmit a rotational force to the shuttles in the respective holders. The main shaft and the lower shaft are connected to each other at the end portions via a driving force transmitting mechanism such as a timing belt. Meanwhile, one end portion of the lower shaft is connected to an output shaft of a drive motor directly or via a driving force transmitting mechanism such as a timing belt, so that the lower shaft and the main shaft may be rotated under revolution of the drive motor. While the needle bars and the thread take-up levers in the respective heads are reciprocated by the main shaft, the shuttle in each shuttle holder is rotated by the lower shaft.

In the prior art multi-head sewing machine, the rotational driving force of the drive motor is adapted to be transmitted to the main shaft and the lower shaft at the shaft ends, as described above. Accordingly, a greater load is applied to the main shaft than to the lower shaft, so that the main shaft is distorted much to cause phase deviation among the needle bars, the thread take-up levers and the shuttles in the respective heads depending on the position of the head, and stitch performance is likely to vary among the heads, disadvantageously. Such phenomenon tends to be the more conspicuous, the greater are the number of heads, and thus the longer becomes the length of the main shaft or the lower shaft.

In order to reduce such distortion occurring in the main shaft, a main shaft having a larger diameter may be employed, but the large diameter main shaft penetrating the respective heads inevitably enlarges the mechanism of transmitting driving force to the needle bars and the thread take-up levers in the respective heads (e.g., the diameter of drive cams to be fitted on the main shaft must be enlarged). In such cases, greater vibration occurs during running of the sewing machine, causing another problem that the sewing machine cannot be operated at a high speed.

SUMMARY OF THE INVENTION

The present invention is proposed in view of the problems inherent in the prior art multi-head sewing machine described above and with a view to solving them successfully, and it is an objective of the present invention to further improve the structure of driving the main shaft and the lower shaft which drive the needle bars and the thread take-up levers in the respective heads of the multi-head sewing machine.

In order to solve the problems described above and to attain the intended object successfully, one aspect of the present invention is to provide a multi-head sewing machine comprising a plurality of heads, having at least a needle bar and a thread take-up lever, arranged in a row; a plurality of shuttle holders corresponding to the number of heads, each supporting therein a shuttle, arranged in a row; a main shaft, penetrating the row of heads, which rotates to drive the needle bar and the thread take-up lever in each head; and a lower shaft, penetrating the row of shuttle holders, which rotates to drive the shuttle in each shuttle holder; wherein the sewing machine further comprises a drive shaft, extended parallel to the main shaft, which is rotationally driven by a drive motor, the rotational driving force of the drive shaft being adapted to be transmitted to the main shaft at more than one position.

Likewise, in order to solve the problems described above and to attain the intended object successfully, another aspect of the present invention is to provide a multi-head sewing machine comprising a plurality of heads, having at least a needle bar and a thread take-up lever, arranged in a row; a plurality of shut fie holders corresponding to the number of heads, each supporting therein a shuttle, arranged in a row; a main shaft, penetrating the row of heads, which rotates to drive the needle bar and the thread take-up lever in each head; and a lower shaft, penetrating the row of shuttle holders, which rotates to drive the shuttle in each shuttle holder; wherein a rotational driving force is adapted to be transmitted from a drive motor to the lower shaft or the main shaft substantially at the middle position, and the end portions of the lower shaft are adapted to be connected to the end portions of the main shaft via torque transmitting mechanisms, respectively.

Likewise, in order to solve the problems described above and to attain the intended object successfully, one aspect of the present invention is to provide a multi-head sewing machine comprising a plurality of heads, having at least a needle bar and a thread take-up lever, arranged in a row; a plurality of shuttle holders corresponding to the number of heads, each supporting therein a shuttle, arranged in a row; a main shaft, penetrating the row of heads, which rotates to drive the needle bar and the thread take-up lever in each head; and a lower shaft, penetrating the row of shuttle holders, which rotates to drive the shuttle in each shuttle holder; wherein rotational driving forces are adapted to be transmitted from drive motors to the end portions of the lower shaft or those of the main shaft, respectively; the end portions of the lower shaft are connected to the end portions of the main shaft via torque transmitting mechanisms, respectively; and the drive motors are designed to be driven synchronously.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments taken in conjunction with the accompanying drawings in which:

Figure 1:
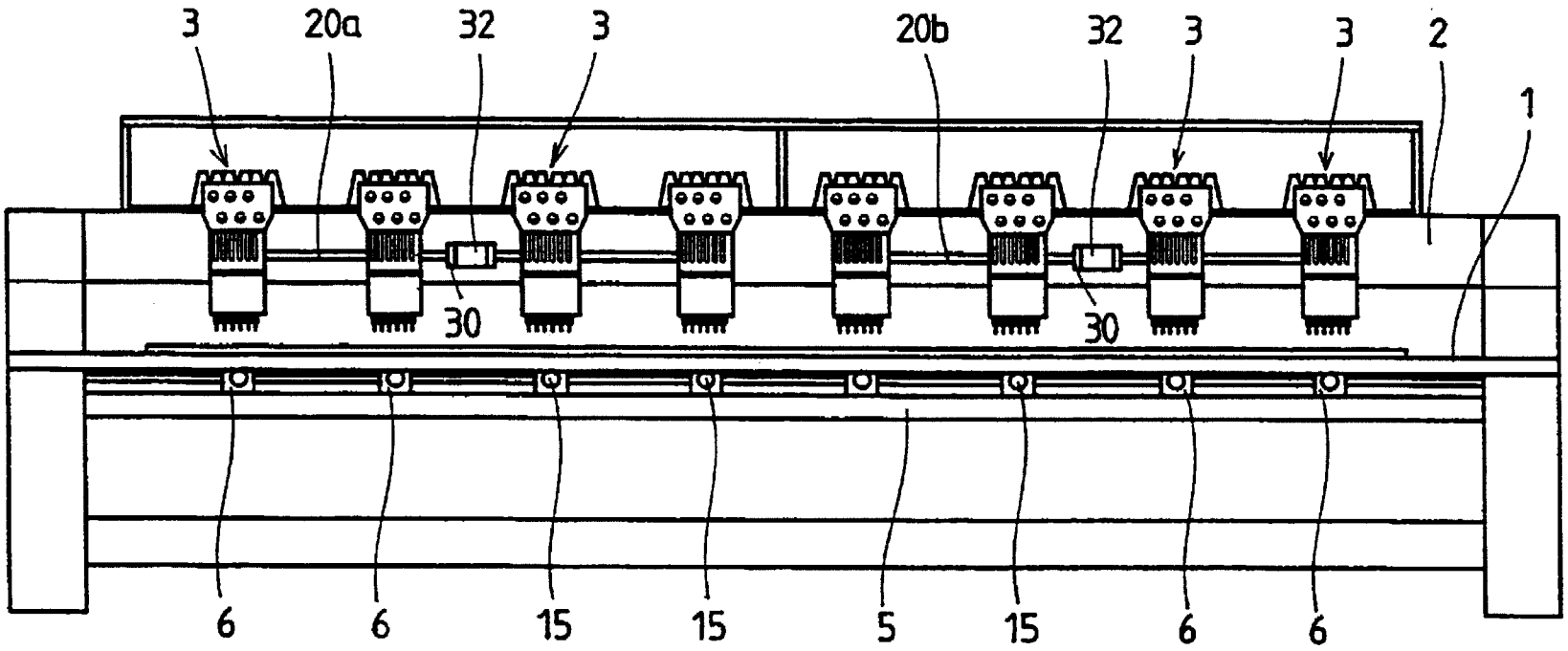
FIG. 1 shows in front view a first embodiment of multi-head sewing machine according to a first aspect of the present invention.

DETAILED DESCRIPTION OF THE PREFERRED EMBODIMENTS (First aspect of the invention)

The multi-head sewing machine according to the present invention will be described below by way of preferred embodiments referring to the attached drawings. First, FIGS. 1 to 6 show a first preferred embodiment according to a first aspect of the present invention, in which eight heads 3 are arranged in a row at equal intervals on the front surface of an upper frame 2 located horizontally above a table 1 (see FIG. 1). Meanwhile, shuttle holders 6 are arranged in a row on the upper surface of a lower frame 5 located below the table 1 to oppose the corresponding heads 3, respectively (see FIG. 2).

Figure 6:
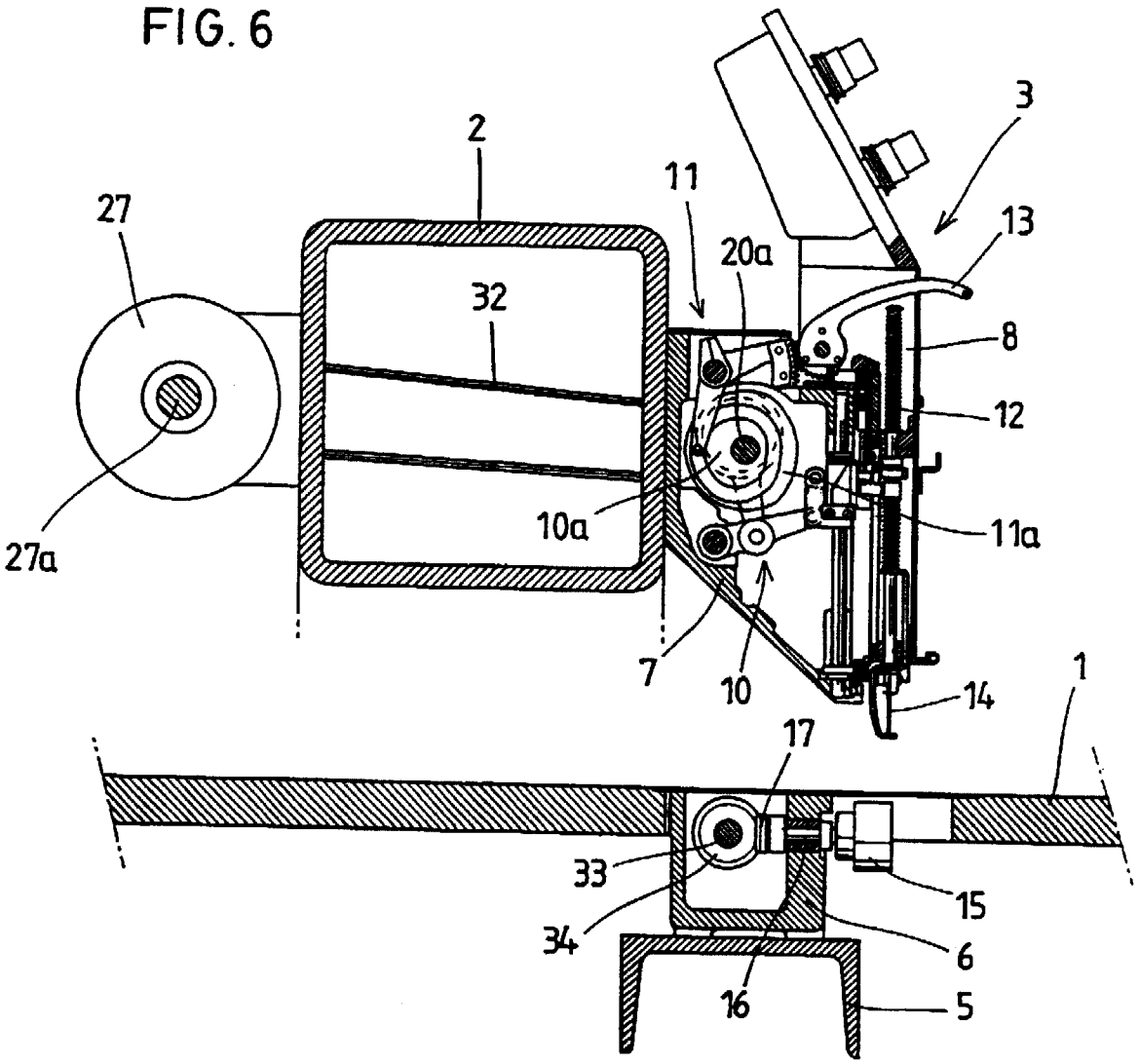
FIG. 6 is an enlarged cross-sectional view taken along the line C—C in FIG. 3.

As shown in FIG. 6, each head 3 consists of an arm 7 fixed on the front surface of the upper frame 2 and a needle bar case 8 supported on the front surface of the arm 7 to be slidable crosswise. A needle bar driving mechanism 10 and a thread take-up lever driving mechanism 11 are incorporated into each arm 7, whereas a plurality of (six in this embodiment) needle bars 12 and a corresponding number of thread take-up levers 13 are supported in each needle bar case 8. Further, in each shuttle holder 6, a shuttle 15 which interlocks with needles 14 attached to the lower end portions of the needle bars 12 is secured to the front end of a shuttle shaft 16 rotatably supported by the shuttle holder 6. A driven gear 17 is attached to the rear end of this shuttle shaft 16.

Figure 2:
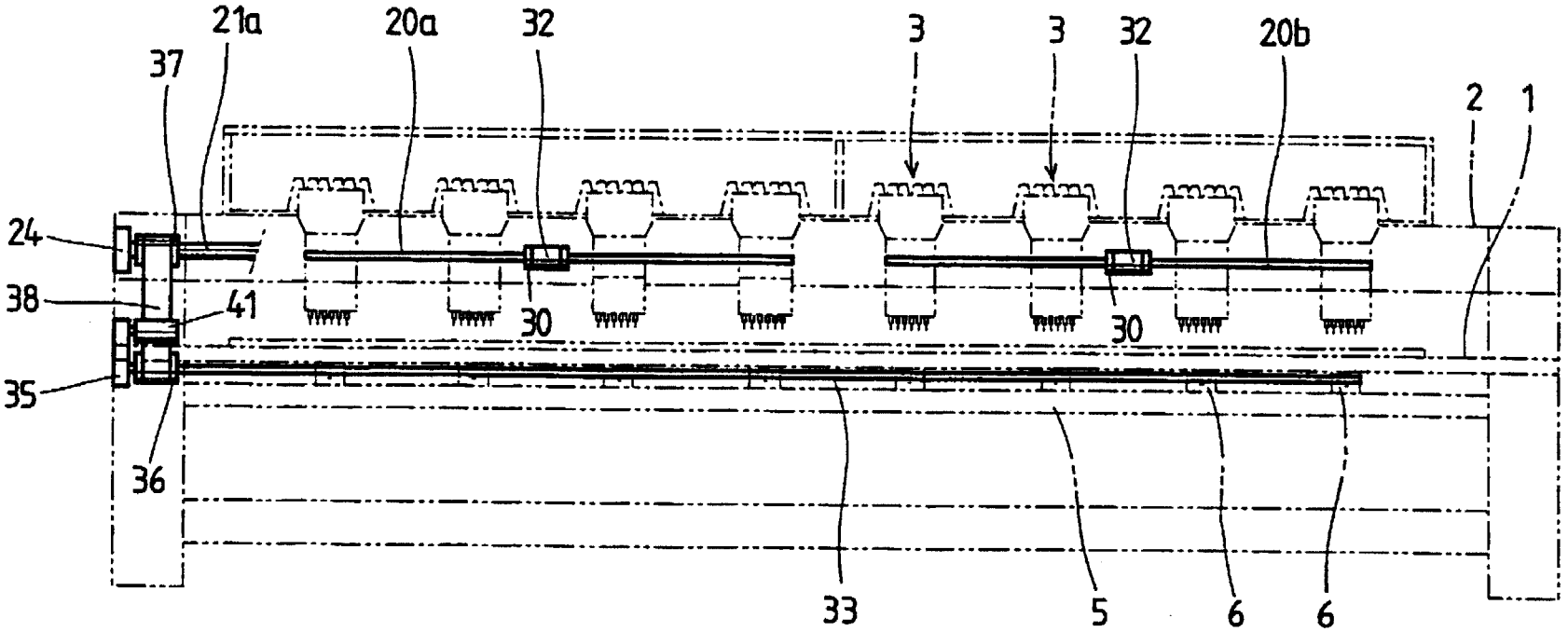
FIG. 2 shows in front view the mechanism for driving the main shaft and the lower shaft in the multi-head sewing machine shown in FIG. 1.
Figure 3:
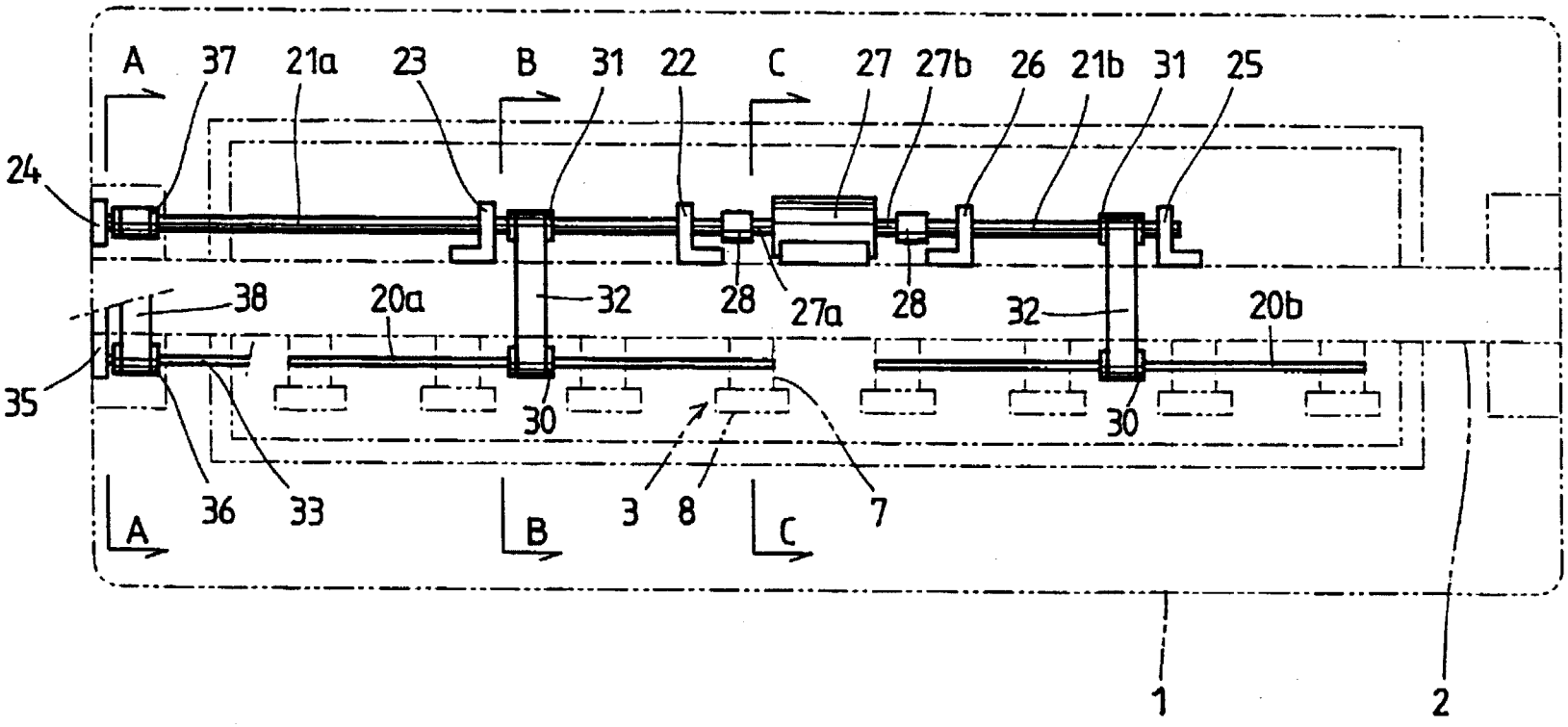
FIG. 3 shows in plan view the mechanism for driving the main shaft and the lower shaft in the multi-head sewing machine shown in FIG. 1.
Figure 4:
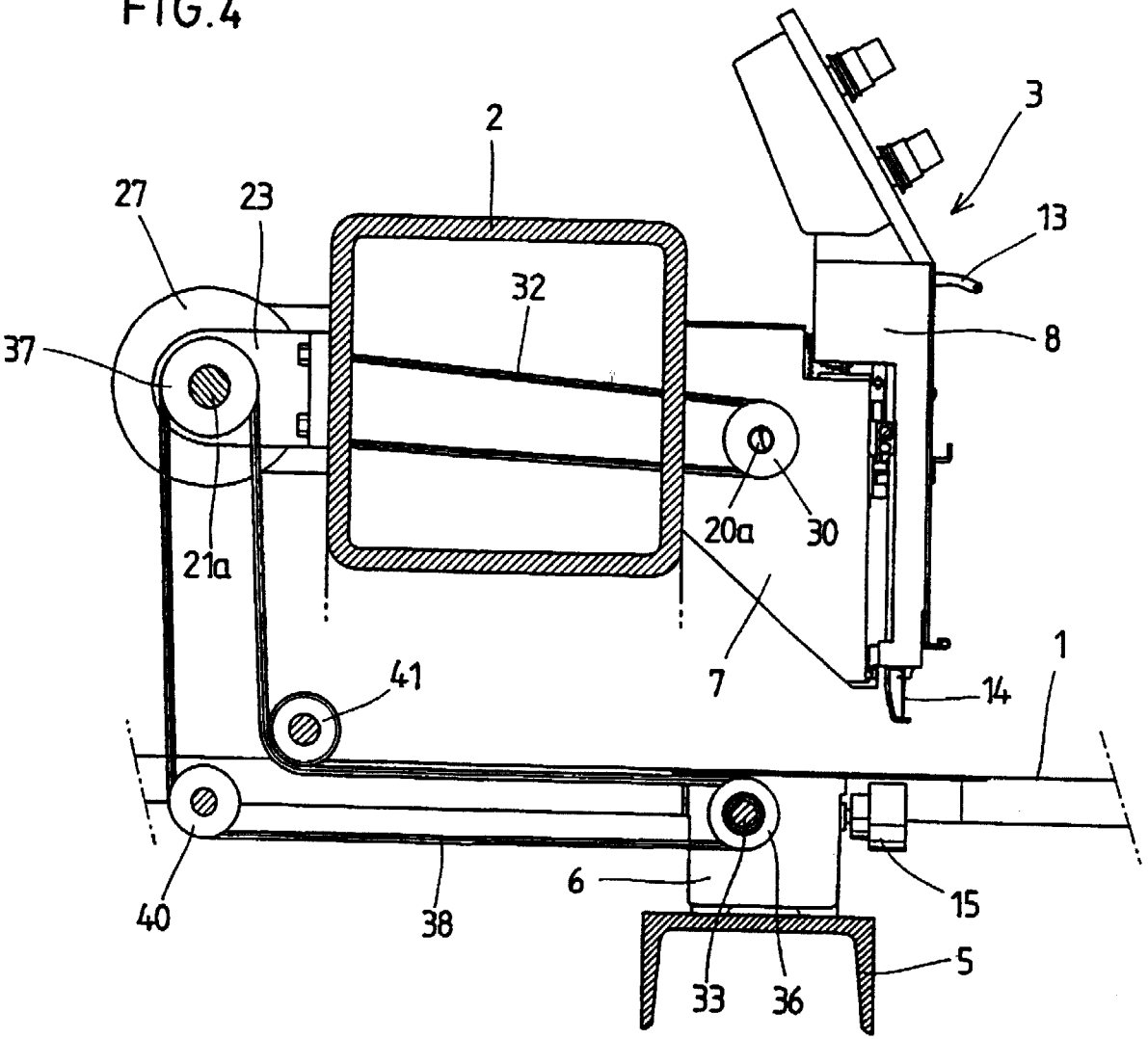
FIG. 4 is an enlarged cross-sectional view taken along the line A—A in FIG. 3.
Figure 5:
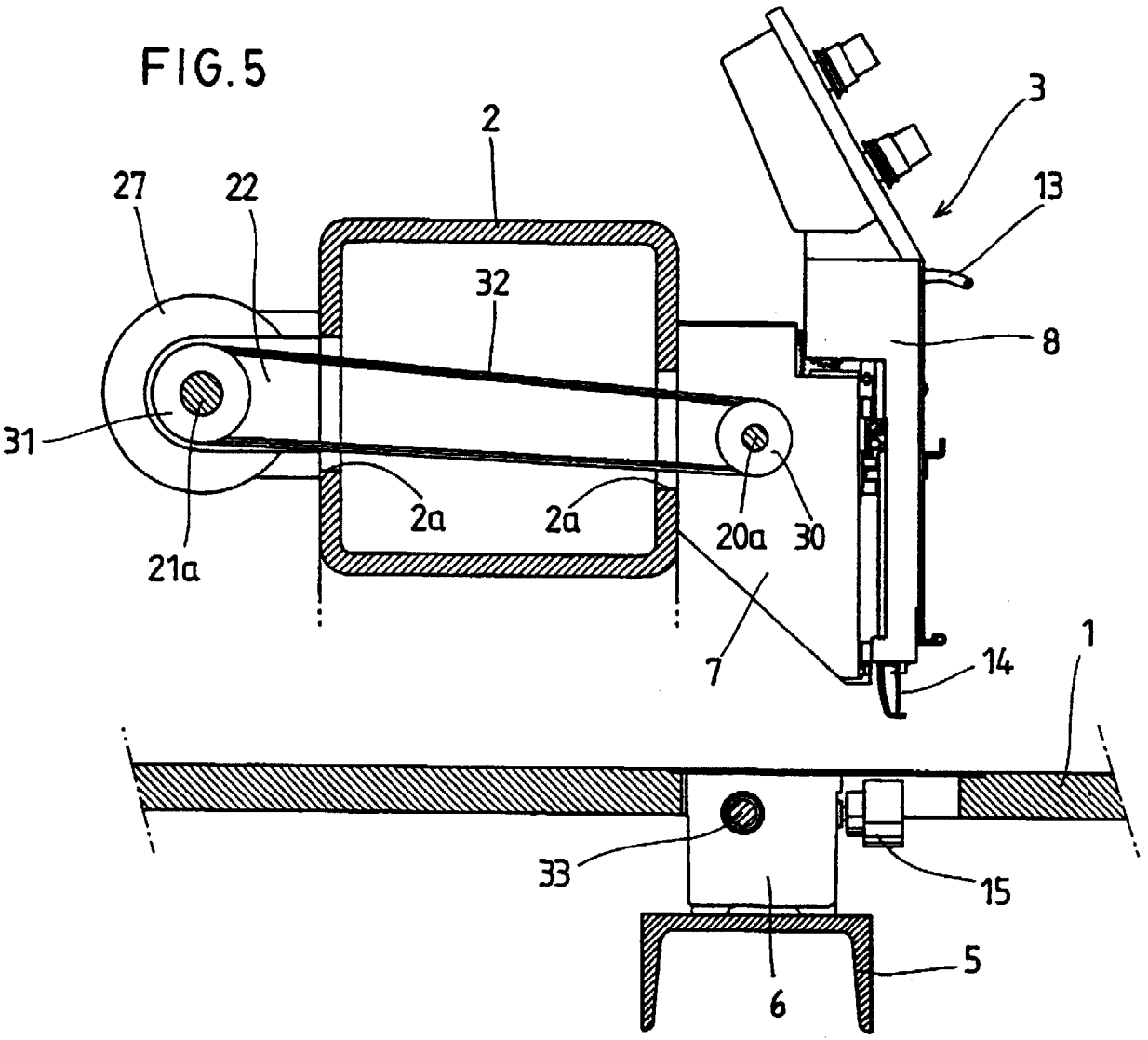
FIG. 5 is an enlarged cross-sectional view taken along the line B—B in FIG. 3.

As shown in FIGS. 1 to 3, main in shafts 20*a* and 20*b* penetrate a group of four arms 7 located on the left side and a group of four arms 7 located on the right side, relative to the center of the multi-head sewing machine, respectively, and these shafts 20*a*,20*b* are supported rotatably by bearings (not shown) provided on the side walls of the arms 7. A needle bar driving cam 10*a* constituting the needle bar driving mechanism 10 and a thread take-up lever driving cam 11*a* constituting the thread take-up lever driving mechanism 11 are fitted on the main shafts 20*a*(20*b* ) within each arm 7. Drive shafts 21*a*,21*b* having a diameter greater than that of the main shafts 20*a*,20*b* are disposed to parallely oppose mainshafts 20*a*,20*b* on the rear side of the upper frame 2. The left drive shaft 21*a* and the fight drive shaft 21*b* are rotatably supported by bearings 22,23,24 and bearings 25,26, fixed on the rear surface of the upper frame 2, respectively. A double-ended drive motor 27 is fixed on the rear surface of the upper frame 2 between the drive shafts 21*a* and 21*b*, and the right end of the drive shaft 21*a* and the left end of the drive shaft 21*b* are connected to the left end of a motor shaft 27*a* and to the right end of a motor shaft 27*b* via couplings 28, respectively.

Timing pulleys 30 are fitted on the main shafts 20*a*,20*b* at the middle positions, respectively, and timing pulleys 31 are fitted on the drive shafts 21*a*,21*b* to oppose the timing pulleys 30, respectively. Timing belts 32, penetrating the upper frame 2 through windows 2*a* (see FIG. 5) defined in the front wall and the rear wall of the frame 2, are wrapped around the opposing pairs of timing pulleys 30,31, respectively. The timing pulley 31 attached to the drive shaft 21*a* and the timing pulley 31 attached to the drive shaft 21*b* are adapted to locate at the same distance from the drive motor 27.

A lower shaft 33 penetrates the shuttle holders 6 and is rotatably supported by bearings (not shown) provided on the side walls of the shuttle holders 6. A drive gear 34 is fitted on the lower shaft 33 to be meshed with the driven gear 17 within each shuttle holder 6. The left end of the lower shaft 33 is supported by a bearing 35, and a timing pulley 36 is fitted on the left end portion of the shaft 33. Another timing pulley 37 is fitted to the left end portion of the drive shaft 21*a* to oppose the pulley 36. A timing belt 38 is wrapped around these timing pulleys 36,37 with tension rollers 40,41 being disposed between them.

Next, actions of the thus constituted embodiment will be described. When the drive motor 27 is first started to rotate the drive shafts 21*a*,21*b* in the same direction, the main shafts 20*a*,20*b* are rotated via the timing belts 32, and thus the needle bars 12 and the thread take-up levers 13 are reciprocated vertically via the needle bar driving mechanisms 10 and the thread take-up lever driving mechanisms 11 in the respective head. The lower shaft 33 is also rotated via the timing belt 38 to rotationally drive the shuttles 15 via the drive gears 34 and the driven gears 17, respectively. Accordingly, the needle bars 12, the thread take-up levers 13 and the shuttles 15 in the respective heads 3 are synchronously driven in predetermined phases, respectively. It should be noted here that in this embodiment, the main shaft is divided into two shorter parts (20*a*,20*b*) which are allotted to the right and left head groups of four respectively, so that the rotational driving force may be applied to the middle portions of the main shafts 20*a*,20*b*, and thus distortion which is likely to occur in the main shafts 20,20*b* can be reduced, advantageously.

In this embodiment, since the rotational driving force of the drive motor 27 is designed to be transmitted to the drive shafts 21*a*,21*b* at the middle between the timing pulleys 31, the drive shaft 21*a* and the drive shaft 21*b* are leveled in the quantity of distortion which is likely to occur at the locations of the timing pulleys 31. Accordingly, the main shafts 20*a*,20*b* rotate in the same phase, and the needle bars 12, the thread take-up levers 13 and the shuttles 15 in the respective heads 3 can be driven substantially in the same phases, respectively. More specifically, there occurs no inconvenience that stitch performance becomes irregular depending on the position of the head 3. While the drive motor 27 is disposed between the timing pulleys 31 fitted on the respective drive shafts 21*a*,21*b* in this embodiment, the drive motor 27 is preferably positioned a little to the left taking it into consideration that the drive shaft 21*a* is distorted by the reactive force applied by the lower shaft 33 via the timing belt 38.

Figure 7:
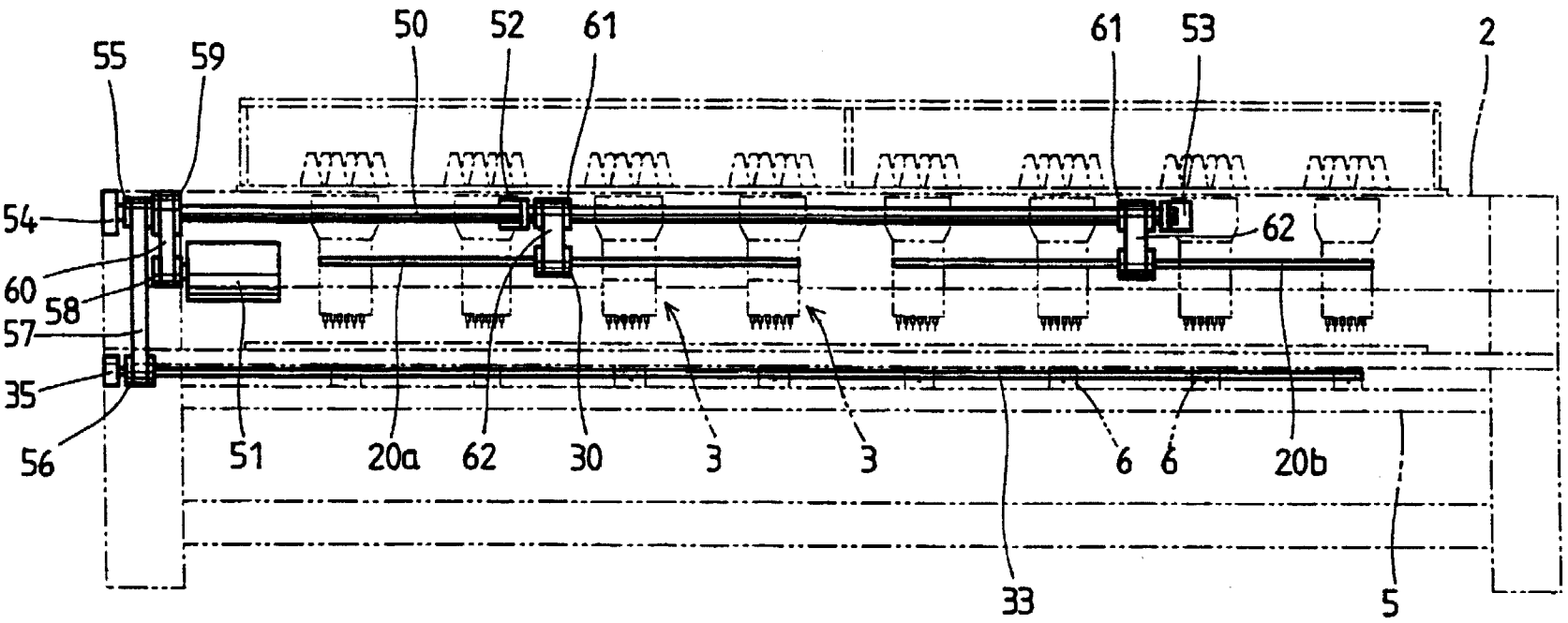
FIG. 7 shows in front view a second embodiment of the mechanism for driving the main shaft and the lower shaft in the multi-head sewing machine according to the first aspect of the present invention.

Next, a second embodiment according to the first aspect of the present invention will be described referring to FIG. 7. In the second embodiment, rotational driving force of a drive motor 51 is adapted to be transmitted to a shaft end of a drive shaft 50. It should be noted here that the same or similar parts as in the first embodiment are affixed with the same reference numbers respectively, and detailed description of them shall be omitted. The drive shaft 50, the diameter of which is greater than that of the main shafts 20*a*,20*b*, is located above the main shafts 20*a*,20*b* parallel to them and is rotatably supported by bearings 52,53,54 fixed on the front surface of the upper frame 2. A timing belt 57 is wrapped around a timing pulley 55 fitted to the drive shaft 50 adjacent to the bearing 54 and a timing pulley 56 fitted to the lower shaft 33 to oppose the timing pulley 55. The drive motor 51 is fixed on the front surface of the upper frame 2 below the left end portion of the drive shaft 50, and a timing belt 60 is wrapped around a timing pulley 58 fitted on the motor shaft and a timing pulley 59 fitted to the drive shaft 50 to oppose the timing pulley 58. A pair of timing pulleys 61 are fitted on the drive shaft 50 to oppose the timing pulleys 30 fitted at the middle of the main shafts 20*a*,20*b*, respectively, and a timing belt 62 is wrapped around each opposing pair of timing pulleys 61,30. In the multi-head sewing machine according to the second embodiment, when the drive motor 51 is started to rotate the drive shaft 50 in a certain direction, the main shafts 20*a*,20*b* are rotated via the timing belts 62, and the lower shaft 33 is also rotated via the timing belt 57 to drive the needle bars 12, the thread take-up levers 13 and the shuttles 15 in the respective heads 3 synchronously in predetermined phases, respectively. Since the main shaft is divided into two shorter parts (20*a*,20*b*) which are allotted to the right and left head groups of four respectively so that the rotational driving force may be transmitted to the middle portions of the respective main shafts 20*a*,20*b*, distortion which is likely to occur in the main shafts 20,20*b* can be reduced like in the first embodiment. Further, since the rotational driving force of the drive motor 51 is adapted to be transmitted to a shaft end of the drive shaft 50, the drive shaft 50 is distorted more than in the first embodiment. However, by allowing the drive shaft 50 to have a diameter large enough to control such distortion to a tolerable range, the main shafts 20*a*,20*b* can be rotated in the same phase like in the first embodiment. Accordingly, in all of the heads 3, the needle bars 12, the thread take-up levers 13 and the shuttles 15 are driven substantially in the same phases respectively, and there occurs no inconvenience that stitch performance becomes irregular depending on the position of the head 3.

(Second aspect of the invention)

Figure 8:
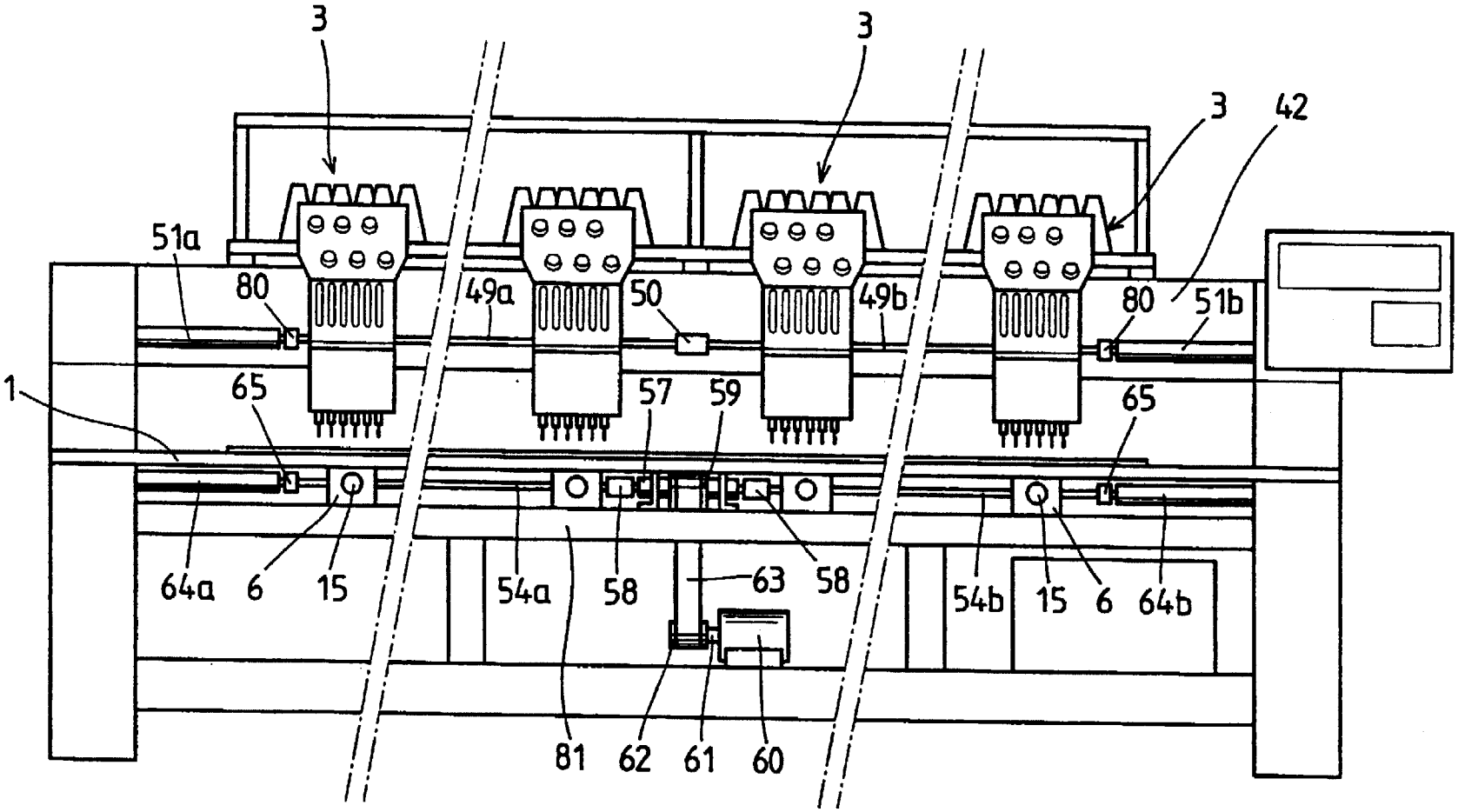
FIG. 8 shows in front view a first embodiment of the multi-head sewing machine according to a second aspect of the present invention.

FIGS. 8 to 12 shows a first preferred embodiment according to a second aspect of the present invention, in which a plurality of heads 3 are arranged at equal intervals on the front surface of an upper frame 42 located horizontally above a table 1 (see FIG. 8). Shuttle holders 6 are arranged in a row on a lower frame 81 to oppose the heads 3 respectively (see FIG. 9).

Figure 11:
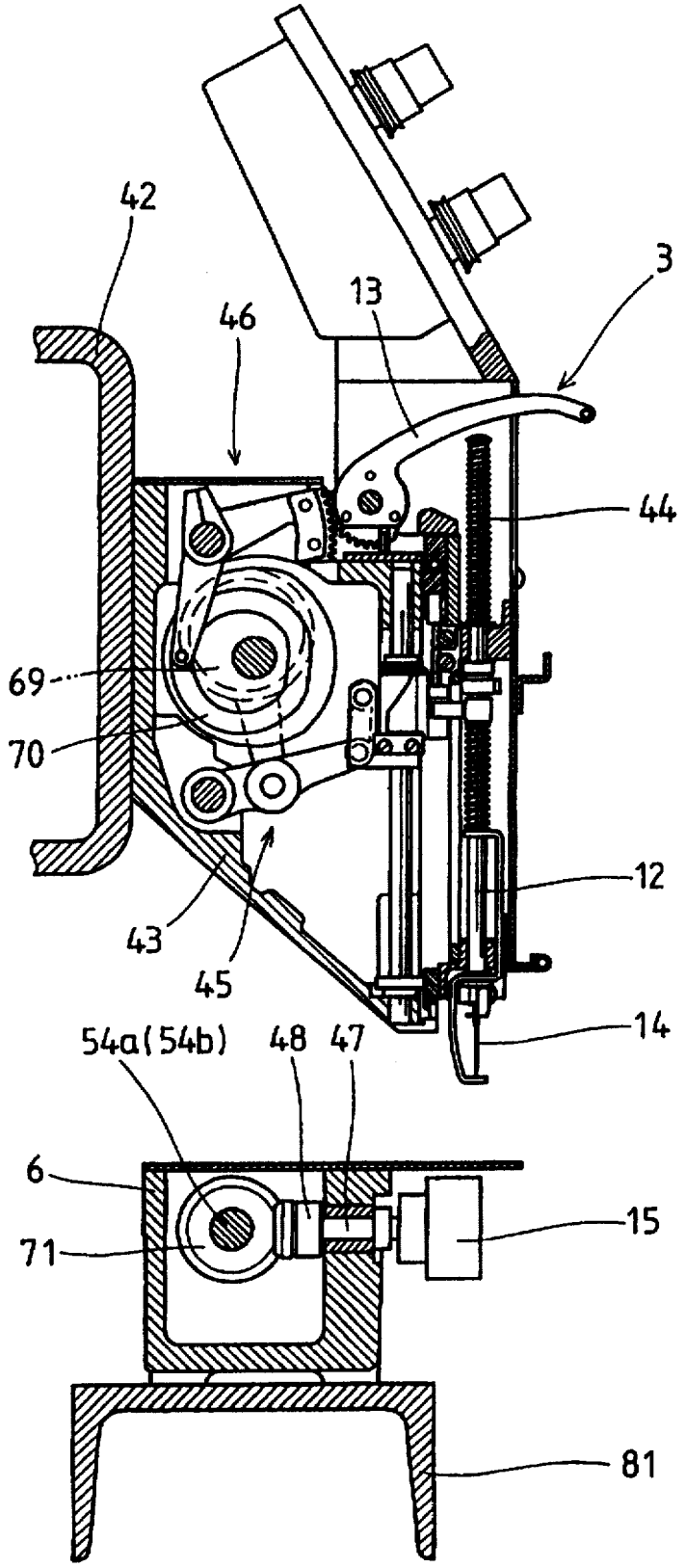
FIG. 11 is an enlarged cross-sectional view of the head and the shuttle holder.
Figure 12:
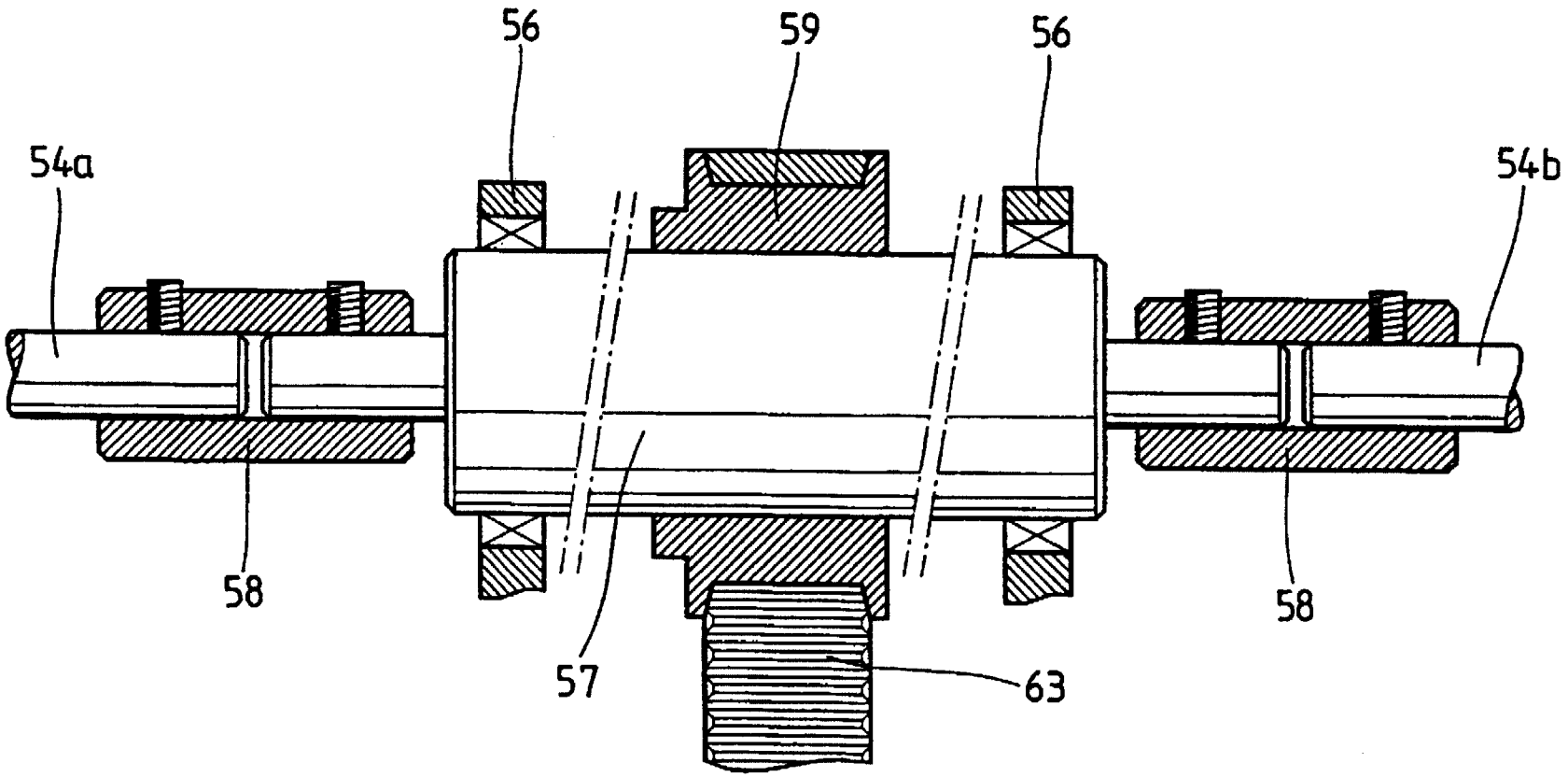
FIG. 12 is an enlarged view of the lower shaft coupling structure in the first embodiment of multi-head sewing machine according to the second aspect of the present invention.

As shown in FIG. 11, each head 3 consists of an arm 43 fixed to the front surface of the upper frame 42 and a needle bar case 44 supported on the front surface of the arm 43 to be slidable crosswise. A needle bar driving mechanism 45 and a thread take-up lever driving mechanism 46 are incorporated into each arm 43, whereas a plurality of (six in this embodiment) needle bars 12 and a corresponding number of thread take-up levers 13 are supported in each needle bar case 44. Further, a shuttle 15, which interlocks with needles 14 attached to the lower end portions of the needle bars 12, is secured to the front end of a shuttle shaft 47. A driven gear 48 is attached to the rear end of this shuttle shaft 47.

Figure 9:
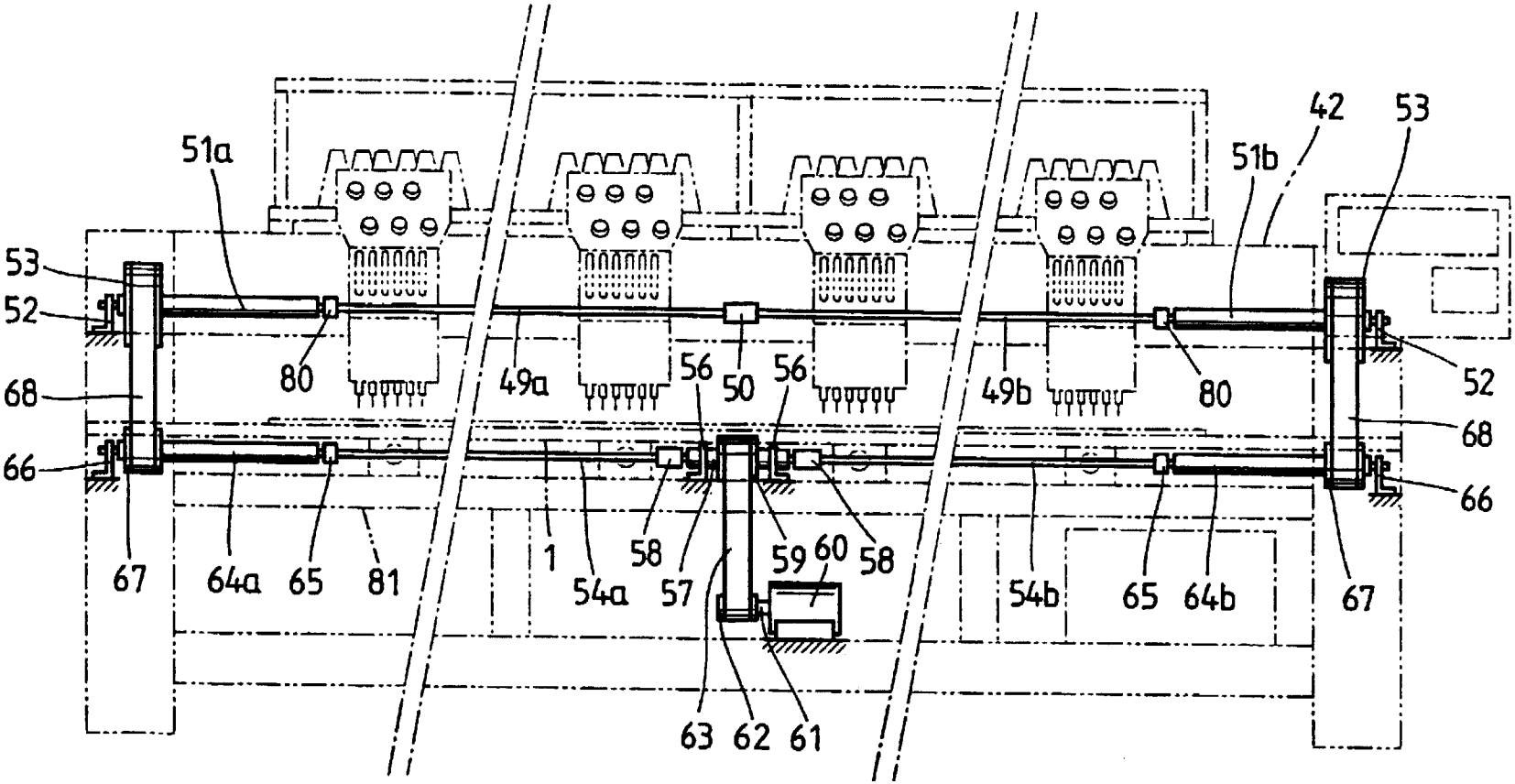
FIG. 9 is an explanatory view of the mechanism for driving the main shaft and the lower shaft in the multi-head sewing machine shown in FIG. 8.

As shown in FIG. 9, main shafts 49*a* and 49*b* penetrate a group of arms 43 located on the left side and a group of arms 43 located on the right side, relative to the center of the multi-head sewing machine, respectively, and they are supported rotatably by bearings (not shown) provided on the respective arms 43. These main shafts 49*a*,49*b* are connected to each other via a coupling 50. Large diameter shafts 51*a*,51*b* are integrally connected to the left end of the left main shaft 49*a* and the right end of the right main shaft 49*b* via couplings 80 respectively (see FIG. 10), and these shafts 51*a*,51*b* are supported at the free end portions by bearings 52 fixed to the machine frame, respectively. Timing pulleys 53 of the same diameter are fitted to the end portions of the large diameter shafts 51*a*,51*b* adjacent to the bearings 52, respectively.

Meanwhile, as shown in FIG. 8, lower shafts 54*a*,54*b* penetrate the group of shuttle holders 6 locating on the left side and the group of shuttle holders 6 locating on the right side, relative to the center of the multi-head sewing machine, and these shafts 54*a*,54*b* are rotatably supported by bearings (not shown) provided on the respective shuttle holders 6. Further, as shown in FIG. 9, a large diameter shaft 57 is supported by bearings 56 fixed to the lower frame 81 and is connected to the inner ends of the lower shafts 54*a*54*b* via couplings 58, respectively. A timing pulley 59 is fitted on the large diameter shaft 57 at the middle, and another timing pulley 62 is fitted to a motor shaft 61 of a drive motor 60 fixed to a lower machine frame. A timing belt 63 is wrapped around the timing pulley 59 of the large diameter shaft 57 and the timing pulley 62 of the drive motor 60.

Figure 10:
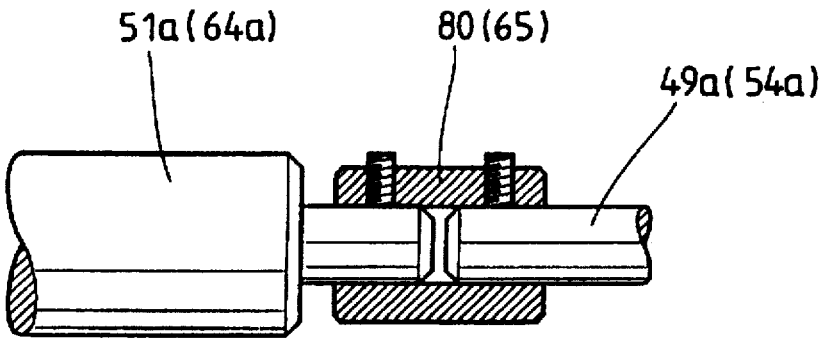
FIG. 10 is an enlarged view of the main shaft coupling structure.
Figure 10:
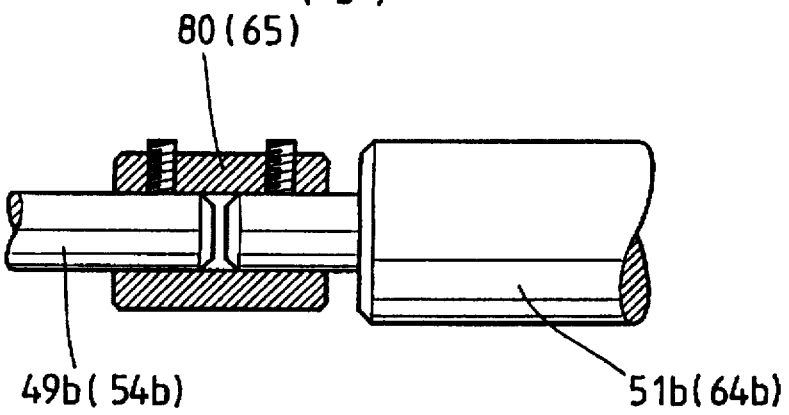

The left end of the lower shaft 54*a* locating on the left side in FIG. 9 is integrally connected to a large diameter shaft 64*a* via a coupling 65, and the right end of the lower shaft 54*b* locating on the right side is integrally connected to a large diameter shaft 64*b* via a coupling 65, as shown in FIG. 10. As shown in FIG. 9, these large diameter shafts 64*a*,64*b* are supported at the free ends by bearings 66 fixed on the machine frame, respectively. Timing pulleys 67 of the same diameter are attached to the end portions of the large diameter shafts 64*a*,64*b* adjacent to the bearings, respectively. A timing belt 68 is wrapped around the timing pulley 67 and a timing pulley 53 attached to the large diameter shaft 51*a*(51*b*). As shown in FIG. 11, drive cams 69 and 70 constituting the needle bar driving mechanism 45 and the thread take-up lever driving mechanism 46 located in each arm 43 are fitted on the main shaft 49*a*(49*b*) shown in FIG. 9. Further, a drive gear 71 is fixed to the lower shafts 54*a*(54*b*) within each shuttle holder 6 shown in FIG. 11 to be meshed with the driven gear 48 of the shuttle shaft 47.

In the first embodiment of the multi-head sewing machine according to the second aspect of the present invention described above, when the drive motor 60 is driven to rotate in a certain direction, the lower shafts 54*a*54*b* are rotated via the center timing belt 63, and also the main shafts 49*a*,49*b* are rotated via the side timing belts 68. Thus, the needle bars 12, the thread take-up levers 13 and the shuttles 15 in the respective heads 3 are driven synchronously. In this first embodiment, since the rotational driving force of the drive motor 60 is adapted to be transmitted to the middle portions of the left and right lower shafts 54*a*54*b* respectively, distortion which is likely to occur in the lower shafts 54*a*54*b* becomes smaller than in the prior art multi-head sewing machine. Meanwhile, since the rotational driving force is transmitted to the main shafts 49*a*,49*b* respectively, distortion which is likely to occur in the main shafts 49*a*,49*b* also becomes smaller than in the prior art multi-head sewing machine. Accordingly, the phases of the needle bars 12, the thread take-up levers 13 and the shuttles 15 do not vary depending on the position of the head 3 to enable stitching such as embroidering properly. Further, in this embodiment: (1) the lower shafts 54*a*54*b* are connected to each other via the large diameter shaft 57; (2) the large diameter shafts 51*a*,51*b* are attached to the outer ends of the main shafts 49*a*,49*b*, respectively; and (3) the large diameter shafts 64*a*,64*b* are attached to the outer ends of the lower shafts 54*a*,54*b*, respectively. Accordingly, distortion which is likely to occur in the main shafts 49*a*,49*b* and in the lower shafts 54*a*,54*b* can be further controlled, advantageously. While the main shafts 49*a*,49*b* are connected to each other via the coupling 50 in this embodiment, they may not be connected to each other in some cases.

Figure 14:
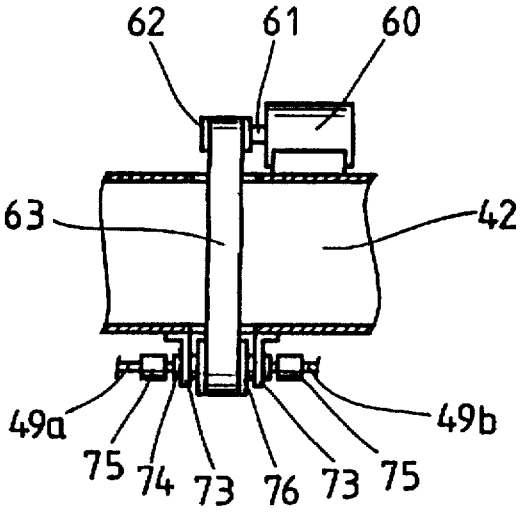
FIG. 14 is an explanatory view of the structure of connecting the drive motor and the main shaft in the second embodiment of multi-head sewing machine according to the second aspect of the present invention.
Figure 13:
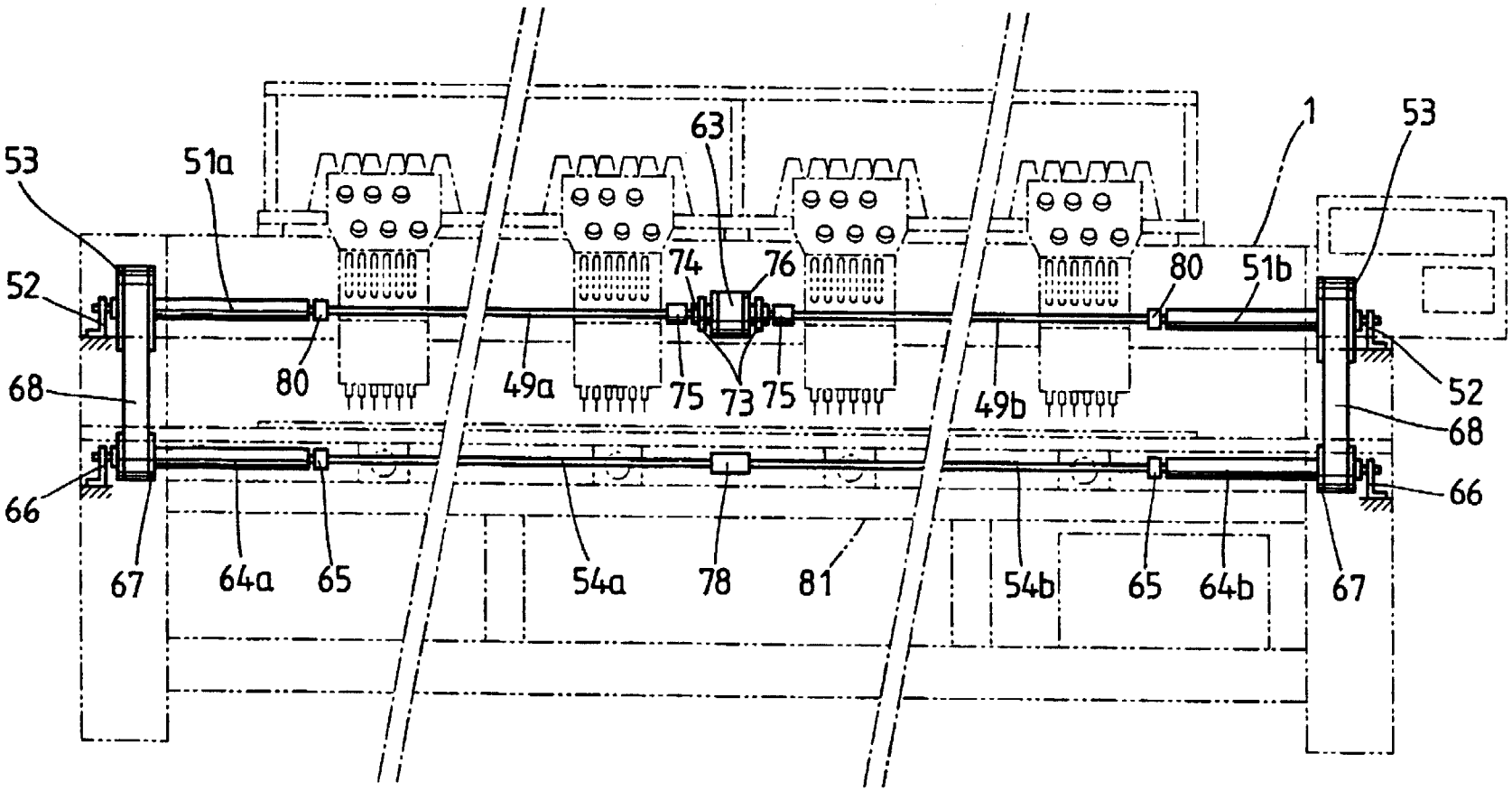
FIG. 13 is an explanatory view of the mechanism for driving the main shaft and the lower shaft in a second embodiment of multi-head sewing machine according to the second aspect of the present invention.

Next, a second embodiment according to the second aspect of the present invention will be described below. The difference between the first embodiment and the second embodiment is that the rotational driving force of the drive motor 60 is adapted to be transmitted to the lower shafts 54*a*,54*b*, respectively, in the first embodiment, whereas the rotational driving force of the motor 60 is adapted to be transmitted to the main shafts 49*a*,49*b*, respectively, in the second embodiment. In FIG. 13, a large diameter shaft 74 is supported by bearings 73 fixed on the front surface of an upper frame 42 between the inner ends of the main shafts 49*a*,49*b* which locate at the center of the sewing machine, and the inner ends of the main shafts 49*a*,49*b* are connected to the large diameter shaft 74 via couplings 75, respectively. A timing pulley 76 is fitted to the center of the large diameter shaft 74, and another timing pulley 62 is fitted on a motor shaft 61 of the drive motor 60 fixed to the rear surface of the upper frame 42 (see FIG. 14). A timing belt 63, penetrating the upper frame 42 through windows 77 (see FIG. 5) defined in the front wall and the rear wall of the frame 42 respectively, is wrapped around the timing pulley 62 and the timing pulley 76 of the large diameter shaft 74. The lower shafts 54*a*54*b* are connected to each other via a coupling 78.

In this second embodiment, when the drive motor 60 is driven to rotate in a certain direction, the main shafts 49*a*,49*b* are rotated via the center timing belt 63. Since the lower shafts 54*a*54*b* are also rotated via the side timing belts 68, the needle bars 12, the thread take-up levers 13 and the shuttles 15 in the respective heads 3 are driven synchronously. Since the rotational driving force of the drive motor 60 is adapted to be transmitted to the middle portions of the left and right main shafts 49*a*,49*b* in the second embodiment, distortion which is likely to occur in the main shafts 49*a*,49*b* becomes smaller than in the prior art multi-head sewing machine. In addition, since the rotational driving force is further transmitted via the main shafts 49*a*,49*b* to the respective lower shafts 54*a*,54*b*, distortion which is likely to occur in the lower shafts 54*a*,54*b* also becomes smaller than in the prior art multi-head sewing machine. Accordingly, the phases of the needle bars 12, the thread take-up levers 13 and the shuttles 15 in the heads 3 do not vary depending on the position of the head 3 to enable stitching such as embroidering properly. While the lower shafts 54*a*54*b* are connected to each other via the coupling 78 in the second embodiment, they may not be connected to each other in some cases.

(Third aspect of the invention)

Figure 15:
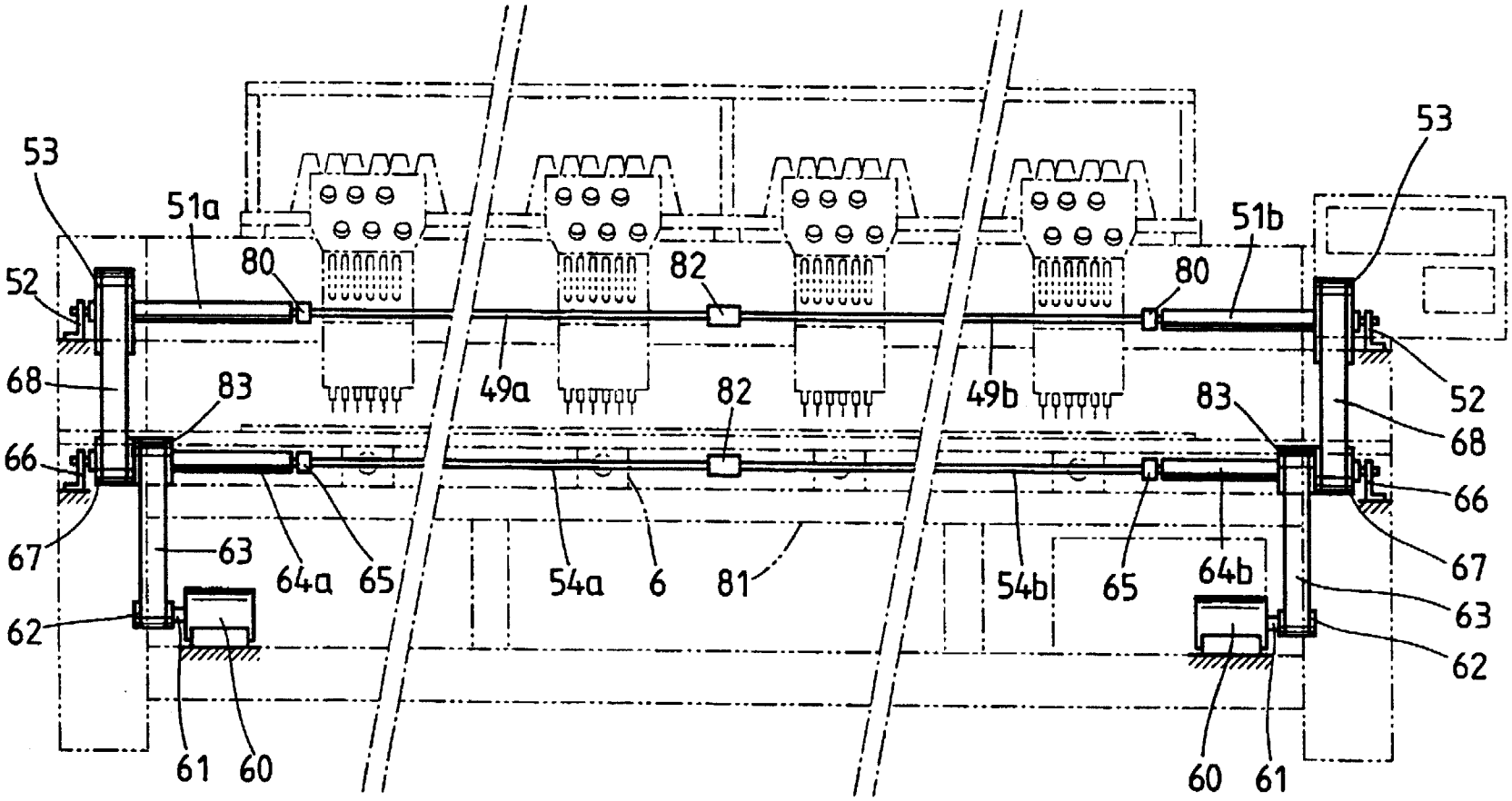
FIG. 15 is an explanatory view of the structure of driving the main shaft and the lower shaft in a first embodiment of multi-head sewing machine according to a third aspect of the present invention.

FIG. 15 shows a first embodiment according to a third aspect of the present invention, in which rotational driving forces of two drive motors 60 provided with respect to the left and right lower shafts 54*a*54*b* are adapted to be transmitted to these shafts 54*a*,54*b*, respectively. More specifically, in FIG. 15, the main shafts 49*a*,49*b* are connected to each other via a coupling 82, whereas the lower shafts 54*a*54*b* are connected to each other via another coupling 82. Timing pulleys 83 of the same diameter are fitted on the lower shafts 54*a*,54*b* adjacent to the timing pulleys 67, respectively. The drive motors 60 are mounted on the machine frame below the timing pulleys 83, respectively. A timing belt 63 is wrapped around each opposing pair of timing pulleys, i.e. the timing pulley 62 attached to the motor shaft 61 and the timing pulley 83 attached to the large diameter shaft 64*a*(64*b*). These two drive motors 60 are adapted to be driven in the same direction synchronously. In this first embodiment again, distortion which is likely to occur in the main shafts 49*a*,49*b* and in the lower shafts 54*a*54*b* becomes smaller than in the prior art multi-head sewing machine. Incidentally, the main shafts 49*a*,49*b* may not be connected to each other in some cases again in this embodiment.

Figure 16:
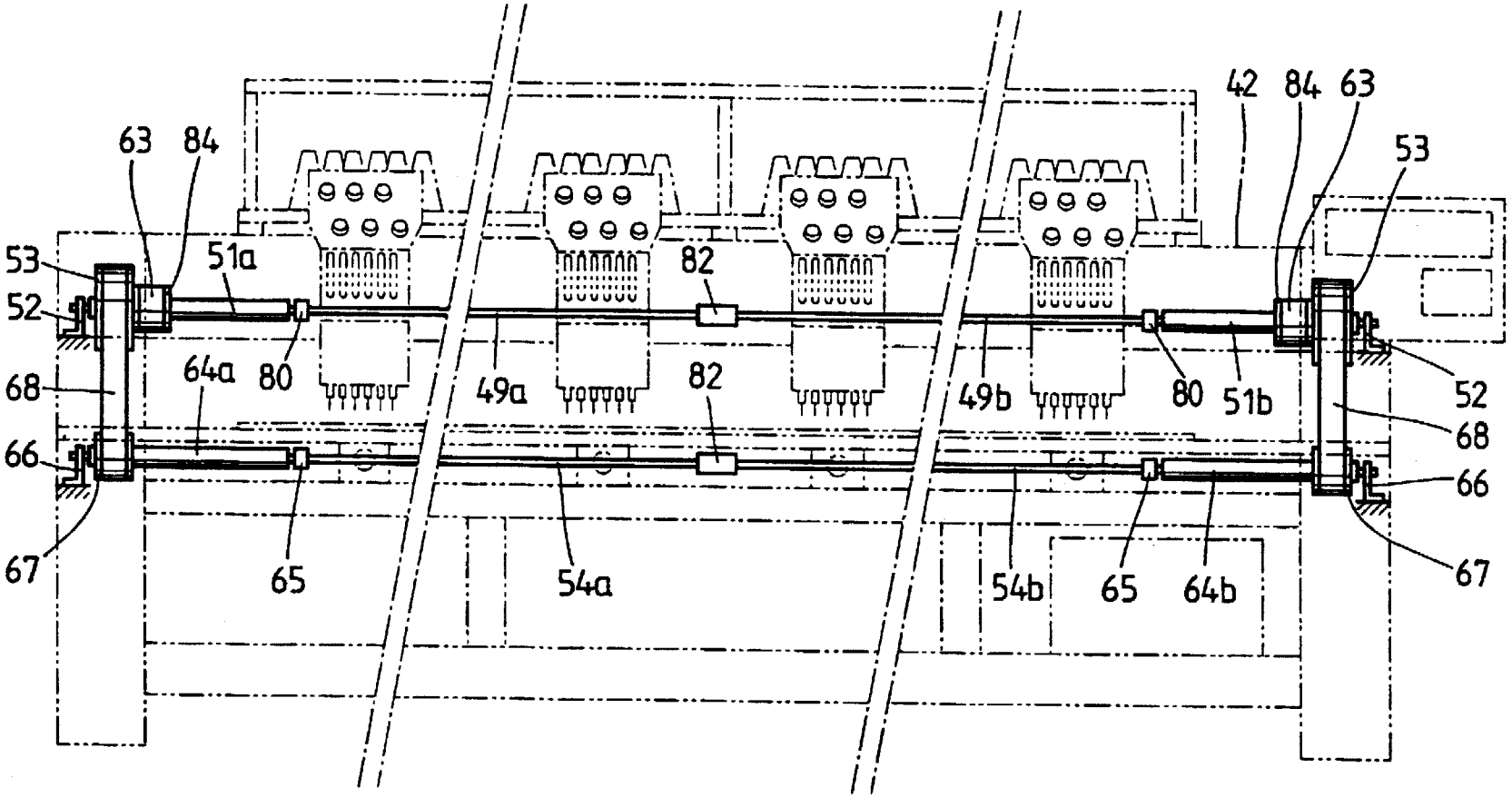
FIG. 16 is an explanatory view of the structure of driving the main shaft and the lower shaft in a second embodiment of multi-head sewing machine according to the third aspect of the present invention.

FIG. 16 shows a second embodiment according to the third aspect of the present invention, in which rotational driving forces of drive motors 60 are adapted to be transmitted to both of the left and right main shafts 49*a*,49*b*. More specifically, in FIG. 16, the main shafts 49*a*,49*b* are connected to each other via a coupling 82, whereas the lower shafts 54*a*54*b* are connected to each other via another coupling 82. Timing pulleys 84 of the same diameter and timing pulleys 53 of the same diameter are fitted on the main shafts 49*a*,49*b* adjacent to each other, respectively. The drive motors 60 are mounted on the rear surface of the upper frame 79 behind the timing pulleys 53, respectively, like in the first embodiment (see FIG. 14). A timing belt 63 is wrapped around each opposing pair of timing pulleys, i.e. the timing pulley 62 attached to the motor shaft 61 and the timing pulley 53. These two drive motors 60 are adapted to be driven in the same direction synchronously. In this second embodiment again, distortion which is likely to occur in the main shafts 49*a*,49*b* and in the lower shafts 54*a*54*b* becomes smaller than in the prior art multi-head sewing machine. Incidentally, the lower shafts 54*a*54*b* may not be connected to each other in some cases again in this embodiment.

As has been described heretofore, according to the multi-head sewing machine of the present invention, the phenomenon that the phases of the needle bars, the thread take-up levers and the shuttles vary greatly depending on the position of the head can be avoided, so that all of the heads exhibit uniform stitch performance to effectively achieve stitching such as embroidering properly. Meanwhile, there is no need of allowing a large-diameter main shaft to penetrate each head or of employing a main shaft and a lower shaft having large diameters, enabling high-speed operation of the multi-head sewing machine with low vibration, without enlarging the needle bar driving mechanism or the thread take-up lever driving mechanism.

Although only a few embodiments of the present invention have been described herein, it should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope of the appended claims.

What is claimed is:

1. A multi-head sewing machine comprising a plurality of heads, having at least a needle bar and a thread take-up lever, arranged in a row; a plurality of shuttle holders corresponding to the number of heads, each supporting therein a shuttle, arranged in a row; a main shaft, penetrating said row of heads, which rotates to drive said needle bar and said thread take-up lever in each head; and a lower shaft, pentrating said row of shuttle holders, which rotates to drive said shuttle in each shuttle holder;

wherein said sewing machine further comprises a drive shaft, extended parallel to said main shaft, which is rotationally driven by a drive motor, the rotational driving force of said drive shaft being adapted to be transmitted to said main shaft at more than one position; and said main shaft is divided into two shorter parts, and the rotational driving force of said drive shaft is adapted to be transmitted to the thus divided main shaft substantially at the middle portion.

* * * * *